United States Patent [19]

Mears

[11] Patent Number: 4,723,671

[45] Date of Patent: Feb. 9, 1988

[54] BOTTLE CAP STAND

[76] Inventor: Gary L. Mears, P.O. Box 303, Republic, Ohio 44867

[21] Appl. No.: 913,996

[22] Filed: Oct. 1, 1986

[51] Int. Cl.[4] ..... B65D 51/24

[52] U.S. Cl. ..... 215/228; 215/237; 222/173; 222/545

[58] Field of Search ..... 215/228, 235, 237; 220/212; 222/105, 173, 545, 546

[56] References Cited

U.S. PATENT DOCUMENTS

| | | | |
|---|---|---|---|
| 1,286,223 | 12/1918 | Bunnell | 248/146 |
| 1,434,921 | 11/1932 | Simpson | 248/109 |
| 1,575,231 | 3/1926 | Seltmann | 248/109 |
| 2,076,826 | 4/1937 | Reinsberg | 220/212 X |
| 2,078,149 | 4/1937 | Lutz | 248/109 |
| 2,496,792 | 2/1950 | Hellberg . | |
| 2,608,843 | 9/1952 | Kennedy | 141/375 X |
| 2,678,146 | 5/1954 | Schleif | 248/311.3 |
| 2,780,081 | 2/1957 | Alexander | 248/146 X |
| 3,317,069 | 5/1967 | Chin | 215/100.5 |
| 3,402,844 | 9/1968 | Chin | 215/100.5 |
| 3,538,866 | 6/1970 | Gaines | 248/146 X |
| 3,655,102 | 4/1972 | Moran | 222/546 X |
| 4,101,044 | 7/1978 | Paquette | 215/228 |
| 4,271,878 | 6/1981 | Bologa | 248/146 X |
| 4,625,898 | 12/1986 | Hazard | 222/546 X |
| 4,629,081 | 12/1986 | McLaren | 215/237 X |

*Primary Examiner*—Donald F. Norton
*Attorney, Agent, or Firm*—Daniel J. Hudak

[57] ABSTRACT

A bottle cap stand permits a bottle to be stored in an inverted position so that the fluid therein is maintained in the vicinity of the bottle opening. The bottle cap stand contains a collar having an aperture therein and a generally flat lid closure means for readily opening and closing the collar aperture. The lid closure means can be integrally connected to the collar. The collar is usually threadily attached to the bottle neck. The bottle cap stand is especially desirous for use with bottles or containers having viscous fluids therein such as hair shampoos, ketchup, and the like, so that the same can be readily dispensed therefrom.

9 Claims, 6 Drawing Figures

BOTTLE CAP STAND

FIELD OF THE INVENTION

The present invention relates to a bottle cap stand for supporting a bottle in an inverted position. More specifically, the present invention relates to a bottle cap stand having a collar with an aperture located therein and to a lid closure means for readily opening and closing the collar aperture.

BACKGROUND OF THE INVENTION

Heretofore, bottles containing less than a full amount of a viscous fluid generally required an undesirable period of time for the fluid to flow to the bottle opening. Moreover, a portion of the fluid was often wasted when the bottle was discarded since it was difficult to remove the last portion of the fluid and additionally since the fluid would coat the sides of the bottle.

U.S. Pat. No. 1,286,223 to Bunnell relates to a measuring device having a base A and a hollow member B for engaging the neck of a bottle. Member B also acts as a measuring and dispensing device and is actuated by lever D.

U.S. Pat. No. 1,434,921 to Simpson relates to a base for containing a collapsible tube.

U.S. Pat. No. 1,575,231 to Seltmann relates to a support device having an internally threaded nut member 17 for engaging a flexible tube.

U.S. Pat. No. 2,076,826 to Reinsberg relates to a collapsible tube closure containing a threadable cap and a skirt which acts as a pedestal or support.

U.S. Pat. No. 2,078,149 to Lutz relates to a stand for a toothpaste tube having a conical replacement cap 11 therein.

U.S. Pat. No. 2,496,792 to Hellberg relates to a combined cover and stand which can be utilized in association with a coffee brewer.

U.S. Pat. No. 2,608,843 to Kennedy relates to a receptacle 10 which can be utilized to catch drippings from a container.

U.S. Pat. No. 2,678,146 to Schleif relates to a glue dispenser having a hollow base 4 which is equipped for holding an accessory such as glue brush.

U.S. Pat. No. 2,780,081 to Alexander relates to a stand for holding a vessel such as a coffemaker top.

U.S. Pat. No. 3,317,069 to Chin relates to a bottle cap stand for holding a bottle such as a ketchup bottle in an inverted position.

U.S. Pat. No. 3,402,844 also to Chin relates to a different cap stand for holding a bottle, such as a ketchup bottle, in an inverted position.

U.S. Pat. No. 3,538,866 to Gaines relates to a dispenser stand having a perforating pin located therein for puncturing and dispensing the contents of a canister.

U.S. Pat. No. 4,101,044 to Paquette relates to a single piece closure cap for supporting a holding a carbonated bottle in an inverted position.

U.S. Pat. No. 4,271,878 to Bologa relates to a plastic molding 20 for holding a ketchup bottle in an inverted position.

Generally, the above patents fail to disclose a quick opening bottle cap stand which supports a bottle in an inverted position, or to such a cap stand wherein an integral lid and collar are connected together through a hinge.

SUMMARY OF THE INVENTION

It is therefore an aspect of the present invention to provide a bottle cap stand for supporting a bottle in an inverted position.

It is another aspect of the present invention to provide a bottle cap stand, as above, wherein the bottle cap stand contains a collar having an aperture therein and a closure lid, and wherein the closure lid readily opens and closes the collar aperture.

It is still another aspect of the present invention to provide a bottle cap stand, as above, wherein the collar and lid are integrally connected through a hinge.

It is a still further apsect of the present invention to provide a bottle cap stand, as above, wherein the collar aperture is of a substantially small size to generally prevent a viscous fluid in an inverted bottle from flowing therethrough.

In general, a bottle cap stand comprises the bottle cap stand attachable to the bottle, said cap stand having a collar and a lid, said lid engaging said collar in a manner such that said collar is readily opened or closed without removing said cap stand from a bottle.

PREFERRED EMBODIMENTS

Figure 1:
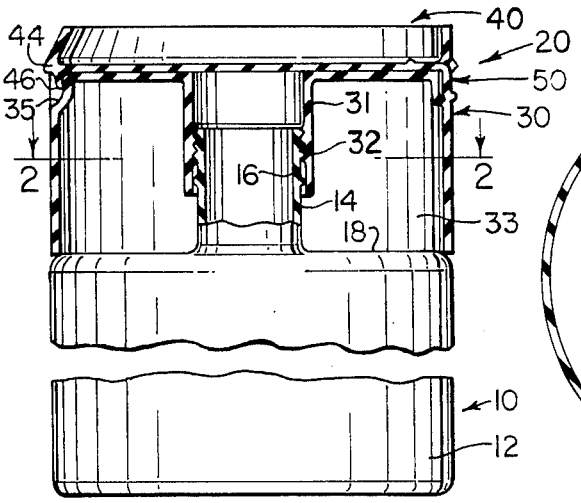
FIG. 1 is a fragmentary cross-sectional view showing the bottle cap stand of the present invention attached to a bottle.
Figure 2:
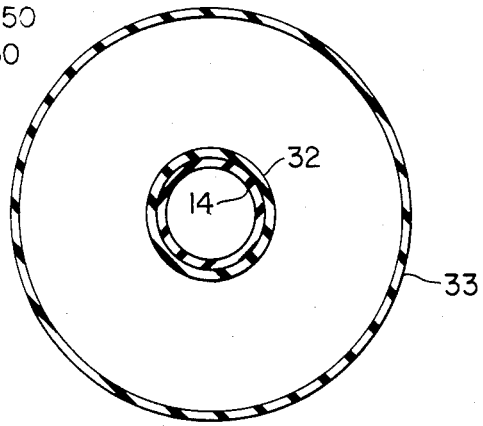
FIG. 2 is a cross-sectional view taken on line 2—2, FIG. 1.

A bottle, generally indicated by the numeral 10, typically relates to a container which can store various fluids therein including a thick or viscous fluids. The bottle generally has a body portion 12 and a neck portion 14 which is generally of a much smaller diameter than the body portion. Neck portion 14 contains a bottle opening therein and generally has an engagement means thereon such as threads 16. The top portion 18 of the bottle is located at the upper most extent of the sides of the bottle and extends therefrom to the neck portion.

The present invention relates to a bottle cap stand, generally indicated by the numeral 20, which enables the bottle to be inverted and stored in an inverted position. Such a cap stand is desirably utilized in association with bottles containing viscous fluids, that is fluids which require an undue amount of time to flow out of a partially full bottle when the bottle is inverted. In other words, at least a couple, a few, or several seconds are required to permit the fluid to flow from out of the interior portion of the bottle. Examples of such viscous fluids include shampoos, thick liquid soaps, ketchup, molassess, and the like.

The bottle cap stand 20 contains a collar, generally indicated by the numeral 30, and a lid, generally indicated by the numeral 40. Desirably, the collar and lid are of a unitary or integral construction and can be connected by a hinge, generally indicated by the numeral 50. The bottle cap stand is preferably made of a plastic material such as polyethylene or polyester, although any conventional plastic material can be utilized. Less desirably, the cap stand can be made out of a metal such as stainless steel, brass, or the like.

Collar 30 has a neck portion 31 which in turn has a fastener means thereon, such as threads 32, for matingly engaging the fastener, such as threads 16, of the bottle. In lieu of threads 32, any other fastener device can be utilized such as a snap-on fitting, and the like. An important aspect of collar 30 is that it draws either lid 40 or collar cover 37, as explained hereinbelow, into a flush contact with the top of bottle opening and prevents the fluid from egressing therefrom.

Figure 3:
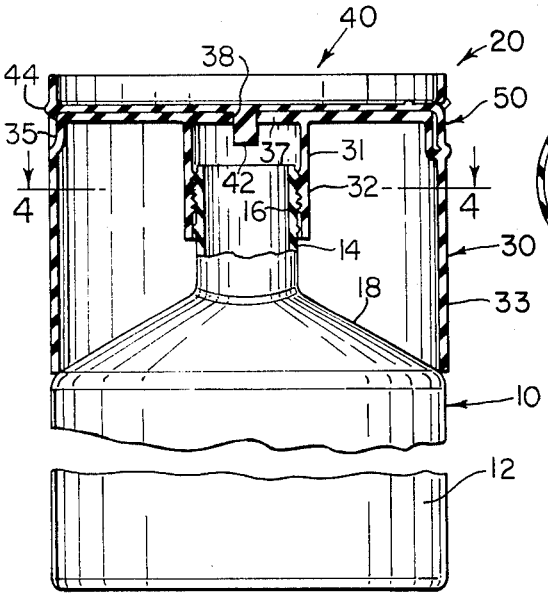
FIG. 3 is a fragmentary cross-sectional view similar to FIG. 1 showing a different embodiment of the bottle cap stand.
Figure 4:
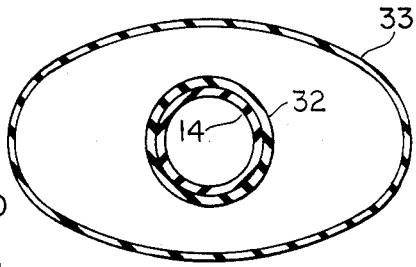
FIG. 4 is a cross-sectional view taken on line 4—4, FIG. 3.
Figure 5:
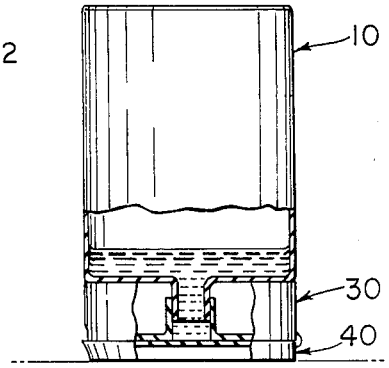
FIG. 5 shows the bottle cap stand supporting an inverted bottle.
Figure 6:
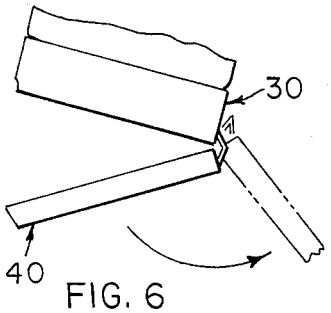
FIG. 6 relates to the opening and closure of the lid.

The collar generally has a skirt portion 33 depending therefrom. The skirt generally extends from the top of the bottle neck portion to top portion 18 of the bottle, as for example shown in FIGS. 1 and 3. Since most bottles are generally cylindrical or elliptical, the collar generally has the shape of a circular or elliptical annulus having an internal or radially inward depending neck portion 31 with threads 32 thereon and an external or radially outward depending skirt 33. The skirt can generally be of any size or shape desired and can enhance the aesthetic appearance of the bottle. Thus, skirt 33 can generally conform to the bottle top 18 in that it generally extends thereto. In other words, the vertical length of the skirt can conform to the height of the bottle neck portion. The size of the skirt can be shaped so that it generally conforms to the size of the bottle. That is, as shown in FIG. 1, the skirt diameter can generally be equal to that of the bottle diameter so that the sides of the skirt create an extension of the bottle sides. However, it is to be understood that many other sizes and shapes can exist as should be apparent to those skilled in the art. For example, skirt portion 33 can have a reduced diameter portion so that the bottle can be easily grasped at said reduced diameter portion. Alternatively, the skirt portion can have an outwardly projection portion at some point along its vertical height to aid in the aesthetic appearance of the bottle or to permit the bottle to be easily grasped thereby. Another feature of the collar is that it generally contains a recess 35 thereon such that the lid can be readily grasped and opened.

When bottle neck portion 14 has a relatively large opening or diameter, collar 30 can optionally contain a cover 37 which extends across a portion of bottle neck opening 14. An aperture 38 exists within the collar cover. The opening size or diameter of cover aperture 38 is generally such that when the bottle is inverted, the fluid will generally not egress quickly therefrom. In other words, the size of aperture 38 is such that the fluid is generally retained in the inverted bottle unless the bottle is squeezed. The relatively small cover aperture thus prevents the viscous fluid from egressing when the lid is open but it is desired that no fluid be emitted therefrom. The aperture can be of any shape or size so long as it can emit fluid therefrom. For example, the aperture can be perforations as extending outward from a common center point so that movable pleats are formed. More traditional forms of apertures include circular openings, elliptcal openings, and the like.

Lid 40, which is attached to collar 30, is generaly readily opened and closed. Moreover, the opening and closing is generally rapid as of a quick nature. That is, the opening and closing of the lid is generally quicker than that required to unscrew a bottle cap if such was located on the bottle. The lid, desirably, engages the top portion of the collar and is flush therewith and seals either the bottle opening or the collar aperture. That it, it is essential that lid 40 when in a closed position prevent or prohibit the bottle fluid from egressing therefrom. Another essential aspect of lid 40 is that it provide a flat support plane as well as a stable support for the bottle when the bottle is placed in an inverted position. Hence, lid 40 is generally wide enough to maintain the bottle in an upright, inverted position, and thus is wider than the bottle neck. The lid can, hence, be smaller than the diameter of the body sidewalls but, desirably, is approximately equal thereto or larger. The lid is also desirably equal in size to the collar. Although the top of the lid is generally flat, it can have various designs as made out of grooves, etc., can exist in the lid so long as a significant portion thereof is generally horizontal.

In order to permit quick and easy opening and closing of the lid, it matingly engages the top portion of the collar as through a snap fitting. For example, a small downwardly extending lid flange 46, as shown in FIG. 1, can extend over a portion of the collar and engage the same through a snap fitting. Numerous other conventional releasable fittings can also be utilized as known to those skilled in the art.

A preferred fitting is the use of a plug 42 in association with cover aperture 38 which depends from the lid and engages the cover aperture. Due to the length of dependent plug 42, lid 40 generally must be stretched so that plug 42 can reside within cover aperture 38 and, hence, will be drawn therein or snapped into position upon the application of a downward pressure to the center portion of the lid. The advantage of a plug fitting is not only that a quick and facile opening and closure engagement is otained; but when stored in an inverted position, the plug, which matingly engages aperture 38, will prevent fluid from flowing or leaking out of the bottle.

A lip 44 can extend radially outward from one portion of lid 40 and in association with collar recess 35, form a projection by which the lid may be readily opened and closed. Naturally, the lid projection and the collar recess are located adjacent to one another. Lip 44 may have any shape so long as it forms a projection which can be readily grasped by a user of the bottle.

The lid, desirably, forms a unitary or integral structure with the collar through hinge 50. The hinge can also be plastic and, hence, the collar, the lid, as well as the hinge, can be molded as one piece in a mold to form the unitary structure. Should a metal cap stand be utilized, the hinge can also be made of metal. Inasmuch as the bottle cap stand of the presnet invention can be utilized a great number of times, the plastic hinge is generally made out of a "living hinge" type material. As shown in the drawings, hinge 50 is generally located at a circumferential extremity of both the lid and the cap and only extends a small portion, that is degree of arc, about the same.

The utilization and operation of applicant's bottle cap stand is as follows: The cap of a bottle having a highly viscous fluid therein, for example hair shampoo, is removed. The unitary collar-lid bottle cap stand 20 is attached to the bottle neck as by matingly engaging collar threads 32 about bottle neck threads 16. The collar is rotated until a snug or flush fit is obtained. When the preferred collar containing a partial cover 37 is utilized, the collar is applied until the cover is drawn snug or flush against the top of the bottle neck portion or opening. The lid can then be closed as by inserting lid plug 42 through collar cover aperture 38. The bottle containing the cap stand thereon is inverted thus permitting the viscous fluid therein to flow to the neck portion of the bottle and to accumulate therein. Upon use of the contents of the bottle, the cover is readily removed through quick release of the lid plug engagement by raising lid lip 44 upward. Inasmuch as the viscous fluid is already located in the vicinity of cover aperture 38, the fluid will readily egress therefrom.

If the collar contains a cover 37, the bottle can simply be squeezed whereby the fluid is readily ejected therefrom. An advantage of the cover cap embodiment is that since cover aperture 38 is of a sufficiently small size to generally prevent fluid from flowing therethrough, the lid can be closed when the fluid is not being dispensed without any unwanted fluid seeping out of the bottle. No fluid residue or undesirable flow material thus accumulates between the collar and the lid.

The present invention thus provides a quick opening, convenient, and stable bottle cap stand.

While in accordance with the Patent Statutes, a best mode and preferred embodiment has been presented, the scope of the claims is not limited thereto, but rather by the scope of the attached claims.

What is claimed is:

1. A quick opening bottle cap stand for a bottle containing a fluid therein, comprising:

the bottle cap stand attachable to the neck opening portion of a bottle, said cap stand having a collar and a lid, said collar having an internal depending neck portion and an external depending skirt, said collar neck portion having an opening therein, said lid engaging said collar in a manner such that said collar neck opening is readily opened or closed without removing said cap stand from said bottle, a hinge, said lid having a flat support plane so that a stable support is provided when said bottle is in an inverted position, said collar, said lid, and said hinge forming a unitary structure, said collar depending neck portion being capable of engaging said bottle neck opening portion, said collar neck portion having threads thereon, said collar neck threads being capable of matingly engaging treads located on said bottle neck opening, and wherein said lid when in a closed position seals said collar neck opening.

2. A quick opening bottle cap stand according to claim 1, wherein said lid has a projection thereon, wherein said collar has a recess therein, said collar recess located adjacent to said lid projection, and wherein said collar. skirt is conformable to the bottle sidewall.

3. A quick opening bottle cap stand according to claim 1, wherein said lid is detachably engaged to said collar.

4. A quick opening bottle cap stand according to claim 1, wherein said collar has a cover extending across said collar neck opening and said cover having an aperture therein.

5. A quick opening bottle cap stand according to claim 4, wherein said lid has a plug depending therefrom, and wherein said lid plug matingly engages said cover aperture and forms a detachable engagement between said lid and said collar.

6. A quick opening bottle cap stand according to claim 5 wherein said lid has a projection thereon, wherein said collar has a recess therein, and wherein said collar recess is located adjacent to said lid projection.

7. A quick opening bottle cap stand according to claim 5, wherein said cover aperture is an effective size such that a viscous fluid in said bottle is usually retained therein when said bottle is in an inverted position.

8. A bottle cap stand for supporting a bottle in an inverted position, comprising:

an integral bottle cap stand, said integral bottle cap stand comprising a collar having an aperture therein, a hinge, and a lid closure means for readily opening and closing said collar aperture, said lid closure means providing a stable support for the bottle when the bottle is in an inverted position, said lid having a plug depending therefrom, said lid plug matingly engaging said collar aperture and forming said closure means, a neck, said neck depending from the internal portion of said collar, said integral cap stand capable of engaging the neck portion of a bottle, a skirt, said skirt depending from the external portion of said collar and being conformable to the sides of said bottle, and said neck having threads thereon, said threads capable of matingly engaging threads located on said bottle neck.

9. A bottle cap stand according to claim 8, wherein said lid has a flat support plane on the top thereof, wherein said lid has a projection extending therefrom, wherein said collar has a recess therein, and wherein said lid projection and said collar recess are located adjacent to one another.

* * * * *